US006781076B2

(12) United States Patent
Takiguchi et al.

(10) Patent No.: US 6,781,076 B2
(45) Date of Patent: Aug. 24, 2004

(54) SWING TYPE MULTI-WAY SWITCH

(75) Inventors: Tsuyoshi Takiguchi, Tokyo (JP); Mitsunori Sato, Tokyo (JP); Naoki Iwao, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 10/630,316

(22) Filed: Jul. 30, 2003

(65) Prior Publication Data

US 2004/0020751 A1 Feb. 5, 2004

(30) Foreign Application Priority Data

Jul. 30, 2002 (JP) ..... 2002-221090

(51) Int. Cl.[7] ..... H01H 25/00
(52) U.S. Cl. ..... 200/316; 200/6 R; 200/339
(58) Field of Search ..... 200/308–317, 200/336–341, 5 A, 6 A, 6 R, 5 R, 17 R, 18

(56) References Cited

U.S. PATENT DOCUMENTS 4,755,909 A * 7/1988 Hibbert et al. ..... 200/308
4,947,008 A * 8/1990 Sato et al. ..... 200/6 R
5,660,270 A * 8/1997 Martin et al. ..... 200/315
6,344,622 B1 * 2/2002 Takiguchi et al. ..... 200/314
6,617,535 B2 * 9/2003 Lacroix ..... 200/339

FOREIGN PATENT DOCUMENTS

| | | |
|---|---|---|
| JP | 8264074 | 10/1996 |
| JP | 8329789 | 12/1996 |
| JP | 10050178 | 2/1998 |

* cited by examiner

*Primary Examiner*—Lincoln Donovan
*Assistant Examiner*—M. Fishman
(74) *Attorney, Agent, or Firm*—David N. Lathrop, Esq.; Gallagher & Lathrop

(57) ABSTRACT

There is provided a swing type multi-way switch in which light irradiated from a light source built therein sufficiently illuminates substantially all over the rear surface of an operation knob. The switch comprises: a box-like operation knob; a square frame-shaped holder disposed in the inside of the operation knob; a case having an outer square tube-like member and an inner square tube-like member coaxially formed; and a base plate on which a light source and a plurality of switch elements are to be mounted. The operation knob is rotatably supported by the holder disposed in the inside of the operation knob, and the holder is rotatably supported by the inner square tube-like member of the case by a second axis for rotating movement orthogonal to the axis for rotating movement of the operation knob. The side wall of the operation knob and the side wall of the holder are disposed in a groove formed between the outer square tube-like member and the inner square tube-like member, and the light source is disposed on substantially the central portion of the inner square tube-like member.

4 Claims, 4 Drawing Sheets

SWING TYPE MULTI-WAY SWITCH

BACKGROUND OF THE INVENTION

1. Field of the Invention

The present invention relates to a swing type multi-way switch of illuminated type that has a light source built therein for illuminating an operation knob or button of the switch.

2. Description of the Related Art

For example, in mobile phones, digital cameras, PDAs (Personal Digital Assistances), car navigation systems, various types of audio-visual equipments or apparatuses and their remote controllers, etc., there is used a swing type multi-way switch in which an operation knob or button thereof can be tilted in plural directions or ways. In general, a multi-way switch comprises an operation knob, and a plurality of switch elements disposed on the periphery of the operation knob and in predetermined plural radial directions therefrom, and it is arranged such that in case of selecting a desired specific function, the operation knob is tilted in one direction of the predetermined plural directions in which the switch elements are disposed to actuate (turn on or off) the corresponding one switch element, thereby to select the desired function.

One example of the swing type multi-way switch is disclosed in Japanese Patent Application Public Disclosure No. 264074/1996 (08-264074) and Japanese Patent Application Public Disclosure No. 329789/1996 (08-329789). This swing type multi-way switch is constructed such that four switch elements thereof are disposed on the periphery of an operation knob thereof and in four radial directions therefrom, one being in the upper side direction, the second being in the lower side direction, the third being in the left side direction, and the fourth being in the right side direction, and one of four functions can be selected by tilting the operation knob in one direction of the upper side, lower side, left side and right side directions and actuating the corresponding one switch element. In addition, one example of the swing type multi-way switch that is also capable of using as a pointing device is disclosed in Japanese Patent Application Public Disclosure No. 50178/1998 (10-050178).

Each of the swing type multi-way switches disclosed in Japanese Patent Application Public Disclosure No. 264074/1996 and Japanese Patent Application Public Disclosure No. 329789/1996 is a four way switch that comprises an operation knob (operation key) and four switch elements (tact or tactile switches), and four operation parts for moving a blinking or winking cursor in the upper side, lower side, left side, and right side directions respectively are formed integrally with the operation key on the upper side, lower side, left side, and right side of the top surface thereof. It is constructed that by depressing one of the four operation parts of the operation key, the operation key is caused to be slanted in one direction of the upper side, lower side, left side, and right side directions to actuate the corresponding one tactile switch, thereby to select a desired specific function. Each of the swing type multi-way switches disclosed in these Japanese Patent Application Public Disclosures is a multi-function switch that is used in an audio-visual equipment installed mainly in a house or home such as an audio system, and its features reside in elimination of incompatibility in operation, reduction of manufacturing cost, and the like. Accordingly, it is clear that in these inventions, there is entirely no technical concept that the operation key (operation knob) should be illuminated. Of course, these Japanese Patent Application Public Disclosures neither disclose nor suggest that the operation key should be illuminated.

The multi-way switch disclosed in Japanese Patent Application Public Disclosure No. 50178/1998 includes an operation shaft, an operation knob mounted on the outer end of the operation shaft, and four switch elements (pressure-actuated switches), and the operation shaft is constructed such that it can be tilted in any directions, be moved in its axial direction by depression thereof, and be rotated about its axis. It is constructed that when the operation knob is tilted in either one direction of the front side, rear side, left side, and right side directions, the corresponding one pressure-actuated switch can be actuated, when the operation knob is depressed, a pressure-actuated switch mounted on a rotary switch of the multi-way switch can be actuated, and when the operation knob is rotated, the rotary switch can be actuated. This multi-way switch is a multi-function switch that is used in, for example, a car navigation system mounted to an automobile, and the operation shaft and the operation knob are mounted on the central portion of the multi-way switch. Moreover, since the multi-way switch has its upper swinging dome mounted thereon, there is entirely no technical concept that the operation knob should be illuminated. Of course, this Japanese Patent Application Public Disclosure neither discloses nor suggests that the operation knob should be illuminated.

Recently, there has been developed a swing type multi-way switch of illuminated type that has an internal light source built therein for illuminating an operation knob or button of the switch as a swing type multi-way switch used in a small-sized or miniature portable electronic apparatus or equipment such as a mobile phone, digital camera, PDA, and the like, in order to make easy the function selecting operation or action of the multi-way switch as well as to make it possible to carry out the function selecting operation of the multi-way switch with ease even in a dim or dark place. A proposed illuminated type multi-way switch is generally constructed such that a light source is disposed under the swinging mechanism thereof and the operation knob or button is illuminated by irradiating it with light from the underside thereof.

However, in a prior art non-illuminated swing type multi-way switch, if a light source is disposed under the swinging mechanism thereof, there occurs a problem that light irradiated from the light source is obstructed by a potion of components that constitute the swinging mechanism so that the light does not reach sufficiently all over the rear surface of the operation knob. Moreover, there is also a problem that the light irradiated from the light source that is disposed under the swinging mechanism leaks from the periphery of the operation knob, which results in bad external appearance of the whole of the multi-way switch.

SUMMARY OF THE INVENTION

It is an object of the present invention to provide a swing type multi-way switch of illuminated type that is constructed such that light irradiated from a light source that is built in the multi-way switch reaches substantially all over the rear surface of an operation knob or button without being obstructed.

It is another object of the present invention to provide a swing type multi-way switch of illuminated type in which a light source built in the multi-way switch is surrounded in its periphery by a square or rectangular tube-like member and a square or rectangular frame-like holder that is fitted in the upper side of the exterior wall of the square or rectangular tube-like member and light irradiated from the light source is prevented from leaking to the outside of the operation knob or button.

In order to accomplish the above objects, in an aspect of the present invention, there is provided a swing type multi-way switch that comprises: a box-like operation knob the top of which is closed and the bottom of which is open; a square frame-shaped holder that is disposed in the inside of the operation knob and rotatably supports the operation knob; a case that has an outer square tube-like member and an inner square tube-like member coaxially formed, and rotatably supports the holder by a second axis for rotating movement orthogonal to the axis for rotating movement of the operation knob, the side wall of the operation knob and the side wall of the holder being disposed in a groove that is formed between the outer square tube-like member and the inner square tube-like member; a base plate on which a light source and a plurality of switch elements are to be mounted, and that supports the case, the light source and the plurality of switch elements being disposed and mounted on the base plate such that when the base plate supports the case, the light source is located on substantially the central portion of the inner square tube-like member of the case as well as the plurality of switch elements are located on the outside of the inner square tube-like member of the case.

In a preferred embodiment, the operation knob is formed into a box-like shape of a generally square in plan, a pair of side walls opposed to each other has projections or tongues that are formed integrally therewith and hang down respectively from the lower ends of substantially the same positions of the central portions thereof, and another pair of side walls opposed to each other has fitting holes formed at substantially the same positions of the central portions thereof, these fitting holes being aligned with a straight line passing through the center of the operation knob and each fitting hole passing through the corresponding side wall.

The holder has a shape of a generally square in plan, a pair of frame components opposed to each other has fitting holes formed at substantially the same positions of the central portions thereof, these fitting holes being aligned with a straight line passing through the center of the holder and each fitting hole passing through the corresponding frame component, and another pair of frame components opposed to each other has support axes for the operation knob formed integrally therewith at substantially the same positions of the central portions thereof, each operation knob support axis fitting in the corresponding one of the fitting holes of the operation knob and projecting outwardly, the aforesaid another pair of frame components further having projections or tongues that are formed integrally therewith and hang down respectively from the lower ends of substantially the same positions of the central portions thereof.

The outer square tube-like member and the inner square tube-like member of the case have shapes of a generally square in plan respectively, the bottom of the outer square tube-like member is coupled to and integrally with the outside wall of the inner square tube-like member by use of a coupling flange at a predetermined height position of the inner square tube-like member from the bottom thereof, and a pair of side walls opposed to each other of the inner square tube-like member has support axes for the holder formed integrally therewith at substantially the same positions of the central portions thereof, each holder support axis fitting in the corresponding one of the fitting holes of the holder and projecting outwardly. The coupling flange has openings formed therein through which the pair of projections of the operation knob and the projections of the holder pass through with a play or gap therebetween, respectively. Both the holder and the case are made of a light opaque material.

The base plate has a shape of a generally square in plan, the light source is disposed on the central portion of the top surface of the base plate, first and third switch elements are aligned with one centerline passing through the light source and disposed on locations where distances from the light source are substantially the same with each other, second and fourth switch elements are aligned with a second centerline orthogonal to said centerline and disposed on locations where distances from the light source are substantially the same with each other, and these switch elements are selectively turned on/off by the pair of projections of the operation knob and the pair of projections of the holder.

With the construction as described above, a light source built in the multi-way switch is surrounded by the inside wall surface of the inner square tube-like member of the case and the inside wall surface of the frame-like holder that is fitted on the outside wall surface of the inner square tube-like member. In addition, the upper portion and the side walls of the frame-like holder are covered by the box-shaped operation knob, and the side walls of the operation knob as well as the side walls of the holder are accommodated in a groove that is formed between the outer square tube-like member and the inner square tube-like member of the case. As a result, the light source lies in the condition that any light from the outside is perfectly shut out. Accordingly, light emitted from the light source does not leak from the periphery of the operation knob.

In addition, since the top of the inner square tube-like member and the top of the holder are open, any member or element obstructing light does not exist at all between the light source and the rear surface of the top wall of the operation knob. Accordingly, light emitted from the light source reaches the rear surface of the top wall of the operation knob substantially without being obstructed so that it can sufficiently and substantially uniformly illuminate almost all over the rear surface of the operation knob.

DETAILED DESCRIPTION OF THE PREFERRED EMBODIMENTS

The preferred embodiment of the present invention will now be described in detail with reference to the accompanying drawings. The present invention may, however, be embodied in many different forms and should not be construed as limited to the embodiment set forth hereinafter; rather, the embodiment is provided so that this disclosure will be thorough and complete, and will fully convey the scope of the invention to those skilled in the art.

Figure 1:
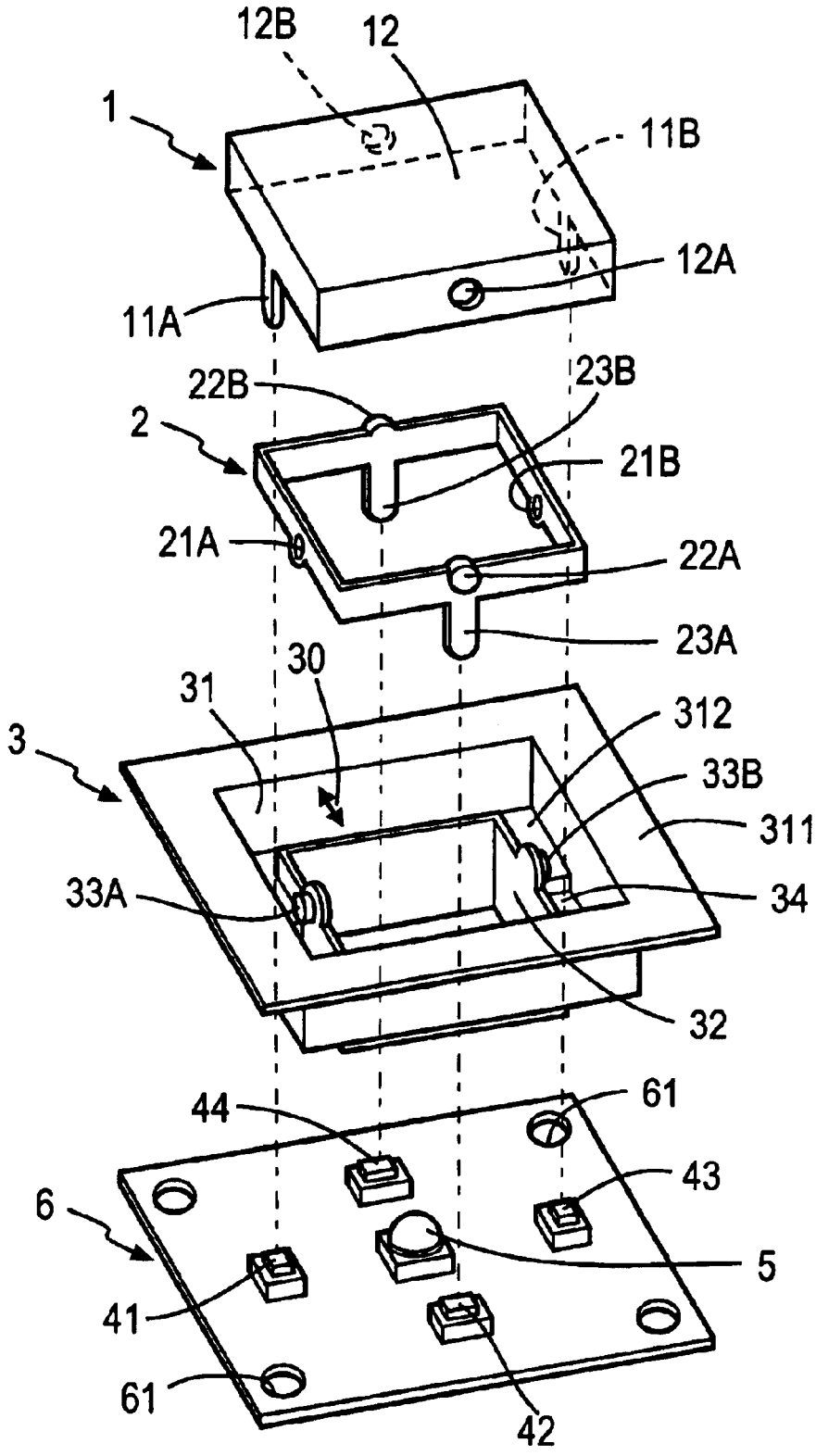
FIG. 1 is a perspective view showing, in exploded state, components of an embodiment of the swing type multi-way switch of illuminated type according to the present invention.
Figure 2:
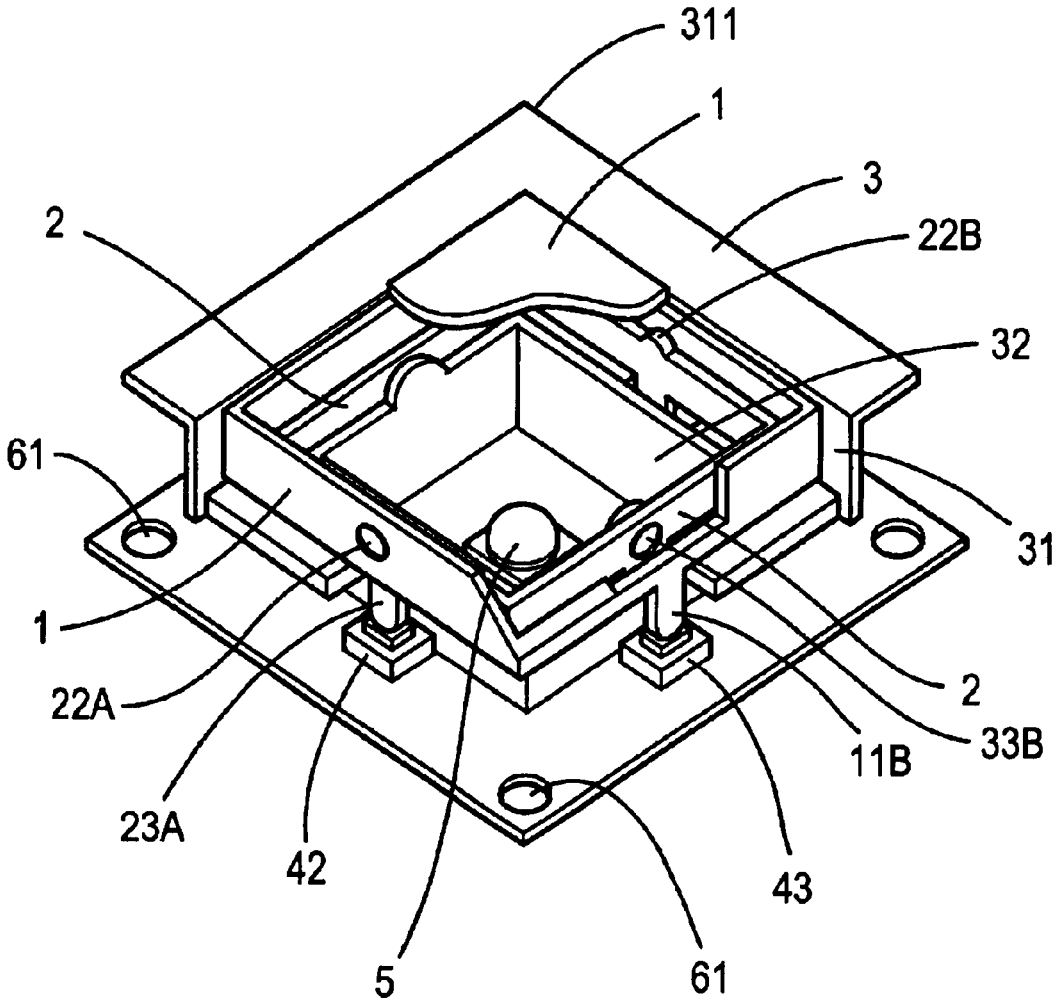
FIG. 2 is a perspective view showing, in assembled state, the components shown in FIG. 1, some of the components being cut off in their portions.
Figure 3:
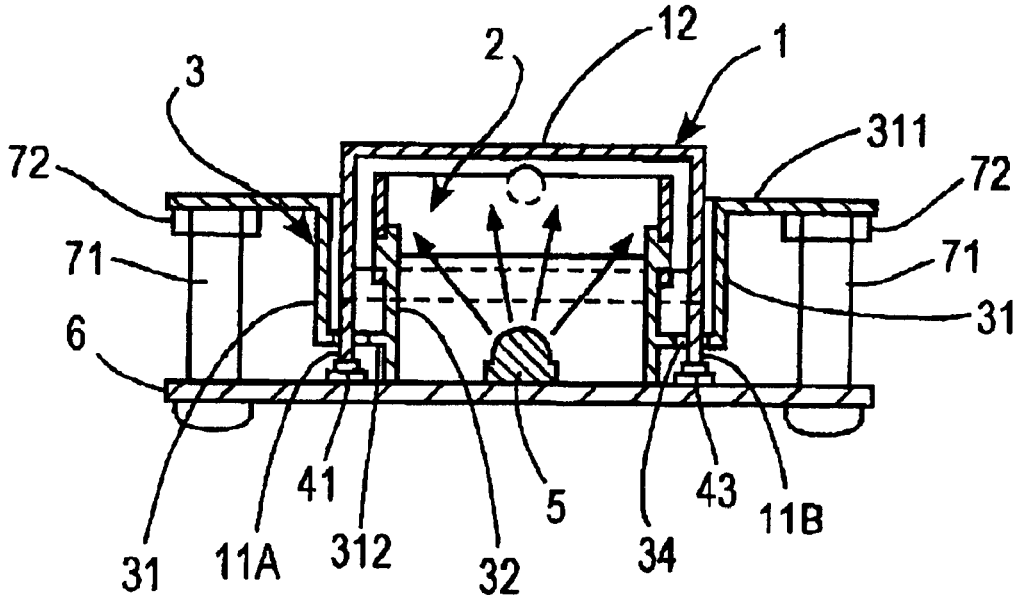
FIG. 3 is a sectional view showing the embodiment of the swing type multi-way switch of illuminated type according to the present invention taken along one centerline passing through the center of the operation knob.
Figure 4:
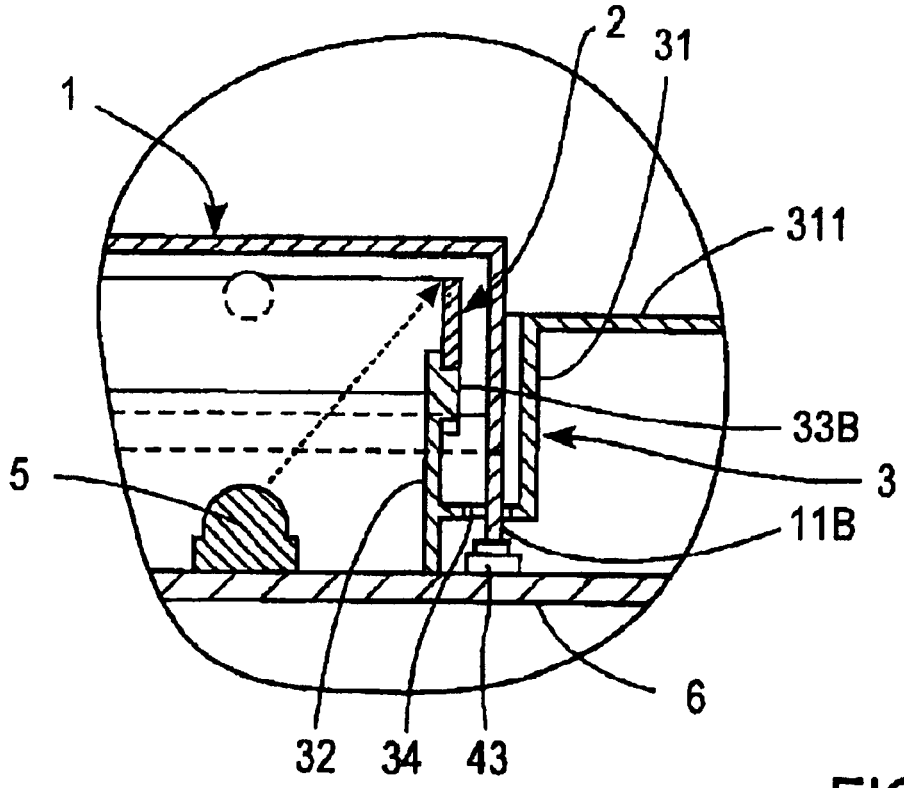
FIG. 4 is an enlarged sectional view showing a portion of FIG. 3.

FIG. 1 is a perspective view showing, in exploded state, components or elements of an embodiment of the swing type multi-way switch of illuminated type according to the present invention, and FIG. 2 is a perspective view showing, in assembled state, the components shown in FIG. 1. In order to show the inside of the multi-way switch in FIG. 2, some of the components are cut off in their portions. FIG. 3 is a sectional view showing the embodiment of the swing type multi-way switch of illuminated type according to the present invention taken along one centerline passing through the center of the operation knob (taken along the centerline connecting the projections 11A and 11B of the operation knob 1 in FIG. 1), and FIG. 4 is an enlarged sectional view showing a portion of FIG. 3.

The illustrated multi-way switch comprises a box-like operation knob or button (hereinafter, referred to as operation knob) 1 of a generally square in plan, a frame-shaped holder 2 of a generally square in plan, a case 3 having outer and inner square or rectangular tube-like members 31 and 32 coaxially aligned each other, each being of a generally square in plan, and a base plate 6 of a generally square in plan.

The operation knob 1 is formed into a box-like shape of a generally square in plan, and the top thereof is closed with its flat top wall 12 of a generally square in plan and the bottom thereof is open. Accordingly, the box-like operation knob 1 is constituted by the flat top wall 12 and the four side walls (vertical walls). A pair of side walls opposed to each other has tongue-like projections 11A and 11B that are formed integrally therewith and hang down from the lower edges of substantially the central portions thereof, respectively. These projections 11A and 11B form extensions of the corresponding side walls, and have their length nearly equal to each other. In addition, another pair of side walls opposed to each other has fitting holes 12A and 12B formed at the same positions of substantially the central portions thereof, each fitting hole passing through the corresponding side wall. These fitting holes 12A and 12B are aligned with a straight line passing through the center of the operation knob 1. The operation knob 1 is made of a light transparent material.

The holder 2 is a frame of a generally square in plan that is formed to have such shape and size that it is accommodated in the inside of the operation knob 1 with a predetermined gap therebetween, and in this embodiment, it is constituted by four plate-like frame components that are parallel with the four side walls of the operation knob 1, respectively. A pair of frame components opposed to each other has fitting holes 21A and 21B formed at the same positions of the lower sides of substantially the central portions thereof, each fitting hole passing through the corresponding frame component. Another pair of frame components opposed to each other has short-length cylindrical support axes 22A and 22B formed at the same positions of the upper sides of substantially the central portions thereof, each support axis projecting outwardly. The aforesaid another pair of frame components on which these support axes 22A and 22B are formed has tongue-like projections 23A and 23B that are formed integrally therewith and hang down from the lower edges of substantially the central portions thereof, respectively. These projections 23A and 23B form extensions of the corresponding frame components, and have their length nearly equal to each other. The aforesaid fitting holes 21A and 21B are aligned with a straight line passing through the center of the holder 2, and the support axes 22A and 22B are aligned with a second centerline substantially perpendicular to this straight line. The holder 2 is made of a light opaque material. In this embodiment, the fitting holes 21A and 21B are formed in portions of the lower edges of substantially central portions of the associated frame components, that are formed by somewhat expanding the lower edges downwardly, and the support axes 22A and 22B are formed on portions of the upper edges of substantially central portions of the associated frame components that are formed by somewhat expanding the upper edges upwardly. However, they are merely one example and it is needless to say that they are not limited to the illustrated example.

The pair of support axes 22A and 22B of the holder 2 swingably fit into the fitting holes 12A and 12B of the operation knob 1 for swinging or rotating movement so that the operation knob 1 is swingably supported by the support axes 22A and 22B of the holder 2 with a very small gap between the side walls of the operation knob 1 through which the fitting holes 12A and 12B are respectively formed and the frame components of the holder 2 on which the support axes 22A and 22B are respectively formed. Further, a gap between the frame components of the holder 2 through which the fitting holes 21A and 21B are respectively formed and the side walls of the operation knob 1 on which the projections 11A and 11B are respectively formed is set to such a value that the operation knob 1 can perform a required swinging movement.

The outer square tube-like member 31 of a generally square in plan of the case 3 has its top opened, and a flange 311 of a generally square in plan is formed integrally with the periphery of this open end of the square tube-like member 31. The inner square tube-like member 32 of a generally square in plan has its top and bottom opened, as can easily be understood from FIG. 3. At a predetermined height position of the inner square tube-like member 32 from the bottom thereof, the bottom of the outer square tube-like member 31 is coupled to the outside peripheral wall of the inner square tube-like member 32 by use of a square flange-like coupling member 312 of a generally square in plan so that the coaxial outer and inner square tube-like members 31 and 32 are formed. In practice, the case 3 constituted by the outer square tube-like member 31, the flange 311, the inner square tube-like member 32, and the flange-like coupling member 312 is formed as one body by use of a light opaque material.

Since the heights of the outer square tube-like member 31 and the inner square tube-like member 32 (the lengths in the axial direction of the square tube-like members 31 and 32) are substantially equal to each other, as can be easily understood from FIG. 3, the outer square tube-like member 31 projects upwardly above the inner square tube-like member 32. In addition, a pair of side walls of the inner square tube-like member 32 opposed to each other has short-length cylindrical support axes 33A and 33B formed at the same positions of the upper sides of substantially the central portions thereof, each support axis projecting outwardly. These support axes 33A and 33B are aligned with a straight line passing through the center of the inner square tube-like member 32. The support axes 33A and 33B are formed on portions of the upper edges of substantially central portions of the associated side walls, that are formed by expanding the upper edges upwardly. However, they are merely one example and it is needless to say that they are not limited to the illustrated example.

The pair of support axes 33A and 33B of the inner square tube-like member 32 swingably fits into the fitting holes 21A and 21B of the holder 2 for swinging or rotating movement so that the holder 2 is swingably supported by the support axes 33A and 33B of the inner square tube-like member 32 with a very small gap between the frame components of the holder 2 through which the fitting holes 21A and 21B are respectively formed and the side walls of the inner square tube-like member 32 on which the support axes 33A and 33B are respectively formed. Accordingly, a gap between the frame components of the holder 2 on which the pair of support axes 22A, 22B and the pair of projections 23A, 23B are respectively formed and the side walls of the inner square tube-like member 32 opposed to these frame components respectively is set to such a value that the holder 2 can perform a required swinging movement. Also, a gap between the pair of side walls of the operation knob 1 swingably supported by the holder 2, through which the pair of fitting holes 12A and 12B is respectively formed and the side walls of the outer square tube-like member 31 opposed to these side walls of the operation knob 1 respectively is set to such a value that the operation knob 1 can perform a required swinging movement.

The straight line connecting between the support axes 33A and 33B of the inner square tube-like member 32, that swingably support the holder 2 is orthogonal to the straight line connecting between the support axes 22A and 22B of the holder 2, that swingably support the operation knob 1. In this manner, the swinging mechanism having two axes orthogonal to each other is a mechanism similar to a universal joint used in what is called joystick or the like, and thus, it is possible to swing the operation knob 1 in all directions. For example, in FIG. 1, when the front side (side near the fitting hole 12A) or the back side (side near the fitting hole 12B) of the top wall 12 of the operation knob 1 is depressed, the operation knob 1 and the holder 2 swing together about the support axes 33A and 33B of the inner square tube-like member 32 as the center axis for rotating movement thereof, and when the left side (side near the projection 11A) or the right side (side near the projection 11B) of the top wall 12 of the operation knob 1 is depressed, only the operation knob 1 swings about the support axes 22A and 22B of the holder 2 as the center axis for rotating movement thereof. Also, when one corner of the top wall 12 of the operation knob 1 is depressed, the corner swings downwardly. That is, the operation knob 1 also swings in the direction forming an angle of 45° with each of the two axes for rotating movement perpendicular to each other. Since the swinging mechanism is a mechanism similar to a universal joint, it is a matter of course that the operation knob 1 can swing in other any directions.

The four plate-like frame components of the holder 2 and the four side walls of the operation knob 1 are accommodated in a ling-like groove 30 of a generally square that is formed between the outer square tube-like member 31 and the inner square tube-like member 32, and therefore, the width (the length in the radial direction) of the groove 30 is set to such a value that the above-mentioned swinging movements of the operation knob 1 and the holder 2 are not prevented. In addition, an opening 34 is formed in the middle portion of each side of the square flange-like coupling member (the bottom of the outer square tube-like member 31) 312 so that when the holder 2 having the operation knob 1 mounted thereto is mounted to the case 3, the tongues 11A, 11B of the operation knob 1 and the tongues 23A, 23B of the holder 2 can pass through the corresponding openings 34 with a play or gap therebetween and project downwardly. These four openings 34 are set to such a size that during the swinging movements of the operation knob 1 and the holder 2, the tongues thereof can be freely moved through the corresponding openings.

On the central portion of the top surface of the base plate 6 of a generally square in plan is disposed a light source 5, and on the periphery of the light source 5 are disposed first, second, third and fourth switch elements 41, 42, 43 and 44 at angular intervals of 90° in positions of the left hand side, right hand side, front side and back side of the light source 5 in this embodiment. The first and third switch elements 41 and 43 are disposed in the left hand and the right hand of the light source 5 with substantially the same distance from the light source 5 in FIG. 1, and the second and fourth switch elements 42 and 44 are disposed in the front side and the back side of the light source 5 with substantially the same distance from the light source 5 in FIG. 1. The first and third switch elements 41 and 43 are disposed at such positions that the tops (for example, in case of a push button switch, the top surface of the button) of the actuators thereof come into contact with the tips of the tongues 11A and 11B of the operation knob 1. The second and fourth switch elements 42 and 44 are disposed at such positions that the tops of the actuators thereof come into contact with the tips of the tongues 23A and 23B of the holder 2. It is preferable that these switch elements 41–44 are pressure-actuated type switches such as push button switches, tactile switches, or the like, which are constructed such that they turn on or off when the actuators thereof are pressed down and when the pressure force on the actuator is removed, that actuator is restored to its original position by, for example, an elastic force of a spring. Further, in the four corners of the base plate 6 are formed through holes 61 into which screws 71 (see FIG. 3) for fixing the case 3 on the base plate 6 are inserted, respectively.

Next, a method of assembling the swing type multi-way switch of illuminated type constructed as discussed above will be explained.

At first, the operation knob 1 is mounted to the holder 2 so as to cover the holder 2, and then the support axes 22A and 22B of the holder are fitted in the fitting holes 12A and 12B of the operation knob 1, respectively. By this assembling, the operation knob 1 is rotatably supported by the holder 2 by making the support axes 22A and 22B of the holder 2 as the center axis for rotating movement thereof. Next, the side walls of the assembly of the operation knob 1 and the holder 2 are inserted in the ling-like groove 30 of a generally square that is formed between the outer square tube-like member 31 and the inner square tube-like member 32 of the case 3 so that the inner square tube-like member 32 of the case 3 is covered by the holder 2, and then the support axes 33A and 33B of the inner square tube-like member 32 are fitted in the fitting holes 21A and 21B of the holder 2, respectively. By this assembling, the holder 2 is rotatably supported by the case 3 by making the support axes 33A and 33B of the inner square tube-like member 32 as the center axis for rotating movement thereof. A the same time, the tongues 11A, 11B of the operation knob 1 and the tongues 23A, 23B of the holder 2 passing through the corresponding openings 34 formed in the bottom of the outer square tube-like member 31 and project downwardly, respectively.

Next, the assembly of the operation knob 1, the holder 2 and the case 3 is mounted on the base plate 6. This mounting is done by inserting the screws 71 into the corresponding through holes 61 from the underside of the base plate 6, engaging the screws 71 with corresponding nuts 72, as shown in FIG. 3, that are fixed respectively on the four corners of the bottom surface of the flange 311 of a generally square in plan of the case 3 in this embodiment, and fastening the case 3 on the base plate 6 with the screws 71. As a result, as shown in FIG. 3, the light source 5 mounted on the central portion of the top surface of the base plate 6 is in the condition that it is situated at substantially the center of the inside of the inner square tube-like member 32 of the case 3 and the periphery of the light source 5 is surrounded by the inside wall surface of the inner square tube-like member 32 and the inside wall surface of the holder 2 that is fitted on the outside wall surface of the inner square tube-like member 32.

In the state that the assembly of the operation knob 1, the holder 2 and the case 3 has been mounted on the base plate 6, the first and third switch elements 41 and 43 are in the condition that the tops of the actuators thereof are in contact with the tips of the projections 11A and 11B of the operation knob 1, and the second and fourth switch elements 42 and 44 are in the condition that the tops of the actuators thereof are in contact with the tips of the projections 23A and 23B of the holder 2 (in FIG. 3, only the switch elements 41, 43 are seen). Accordingly, the operation knob 1 lies in a horizontal position as shown in FIG. 3, and no switch element is actuated.

In the condition shown in FIG. 3, when one side of the operation knob 1, for example, the side including the projection 11A of the top surface (the left hand side in FIG. 3) of the top wall 12 of the operation knob 1 is depressed, the operation knob 1 rotates to the left hand side (in counter-clockwise direction) in FIG. 3 by making the support axes 22A and 22B of the holder 2 as the center axis for rotating movement thereof so that the operation knob 1 is tilted to the left hand side. As a result, the projection 11A of the operation knob 1 presses the actuator of the first switch element 41 down so that the actuator is depressed against the elastic force and the first switch element 41 turns on, for example. When the depressing force on the operation knob 1 is released, the operation knob 1 is restored to its original horizontal position by the elastic force acting to return the actuator of the first switch element 41 to its original position. Consequently, the first switch element 41 turns off. Likewise, when another side of the operation knob 1, for example, the side including the projection 11B of the top surface (the right hand side in FIG. 3) of the top wall 12 of the operation knob 1 is depressed, the operation knob 1 rotates to the right hand side (in clockwise direction) in FIG. 3 by making the support axes 22A and 22B of the holder 2 as the center axis for rotating movement thereof so that the operation knob 1 is tilted to the right hand side. As a result, the projection 11B of the operation knob 1 presses the actuator of the third switch element 43 down so that the third switch element 43 turns on, for example. When the depressing force on the operation knob 1 is released, the operation knob 1 is restored to its original horizontal position by the elastic force acting to return the actuator of the third switch element 43 to its original position. Consequently, the third switch element 43 turns off.

When another side of the operation knob 1, for example, the side including the fitting hole 12A of the top surface (the front side in FIG. 3) of the top wall 12 of the operation knob 1 is depressed, the operation knob 1 and the holder 2 rotate together to the front side in FIG. 3 by making the support axes 33A and 33B of the case 3 as the center axis for rotating movement thereof so that the operation knob 1 is tilted to the front side. As a result, the projection 23A of the holder 2 presses the actuator of the second switch element 42 down so that the second switch element 42 turns on, for example. When the depressing force on the operation knob 1 is released, the operation knob 1 is restored to its original horizontal position by the elastic force acting to return the actuator of the second switch element 42 to its original position. Consequently, the second switch element 42 turns off. Similarly, when another side of the operation knob 1, for example, the side including the fitting hole 12B of the top surface (the back side in FIG. 3) of the top wall 12 of the operation knob 1 is depressed, the operation knob 1 and the holder 2 rotate together to the back side in FIG. 3 by making the support axes 33A and 33B of the case 3 as the center axis for rotating movement thereof so that the operation knob 1 is tilted to the back side. As a result, the projection 23B of the holder 2 presses the actuator of the fourth switch element 44 down so that the fourth switch element 44 turns on, for example. When the depressing force on the operation knob 1 is released, the operation knob 1 is restored to its original horizontal position by the elastic force acting to return the actuator of the fourth switch element 44 to its original position. As a result, the fourth switch element 44 turns off.

As described above, it is possible to actuate one required switch element among the four switch elements 41–44 by tilting the operation knob 1 in a predetermined direction, thereby to select a required function.

The swing type multi-way switch according to the present invention constructed as discussed above has the light source 5 built therein. As can be easily understood from FIG. 3, the periphery of the light source 5 is surrounded by the inside wall surfaces of the inner square tube-like member 32 of the case 3 and the inside wall surfaces of the holder 2 that is fitted on the outside wall surfaces of the inner square tube-like member 32. In addition, the upper portions and the side walls (four plate-like frame components) of the holder 2 are covered by the operation knob 1, and the lower portions of the side walls of the operation knob 1 as well as the lower portions of the side walls of the holder 2 are accommodated in the ling-like groove 30 of a generally square in plan that is formed between the outer square tube-like member 31 and the inner square tube-like member 32 of the case 3. For this reason, the light source 5 lies in the condition that any light from the outside is perfectly obstructed. In other words, merely a gap exists between the top of the holder 2 and the rear surface of the top wall of the operation knob 1. Moreover, both the holder 2 and the case 3 are made of a light opaque material, and hence light irradiated from the light source 5 (as shown by solid line arrows in FIG. 3 and by a dotted line arrow in FIG. 4) does not leak from the periphery of the operation knob 1. As a result, there does not occur at all a problem that light leaks from the periphery of the operation knob 1 thereby to result in bad external appearance of the whole of the multi-way switch.

On the other hand, the top of the inner square tube-like member 32 and the top of the holder 2 are open, and therefore, any member or element that shuts off light does not exist at all between the light source 5 and the rear surface of the top wall 12 of the operation knob 1. Accordingly, light emitted from the light source 5 on the whole reaches the rear surface of the top wall 12 of the operation knob 1, as shown in FIG. 3 by the solid line arrows, except that a only little light is obstructed by the upper portion of the inside wall surface of the holder 2 so that it sufficiently and substantially uniformly illuminates almost all over the rear surface of the operation knob 1. That is, light emitted from the light source 5 reaches the rear surface of the top wall 12 of the operation knob 1 substantially without being obstructed and sufficiently and substantially uniformly illuminates almost all over the rear surface of the operation knob 1. As a result, for example, in case there are indications such as a sign, symbol, mark, letter, or the like on the top surface of the top wall of the operation knob 1, that indicate respective functions, these indications stand out by illumination from the light source 5, which results in an advantage that the function selecting operation of the multi-way switch becomes very easy. In addition, since it is possible to carry out the function selecting operation of the multi-way switch with ease even in a dim or dark place, room, location, or the like, there is obtained an advantage that an incorrect or erroneous selecting operation hardly occurs.

Figure 5:
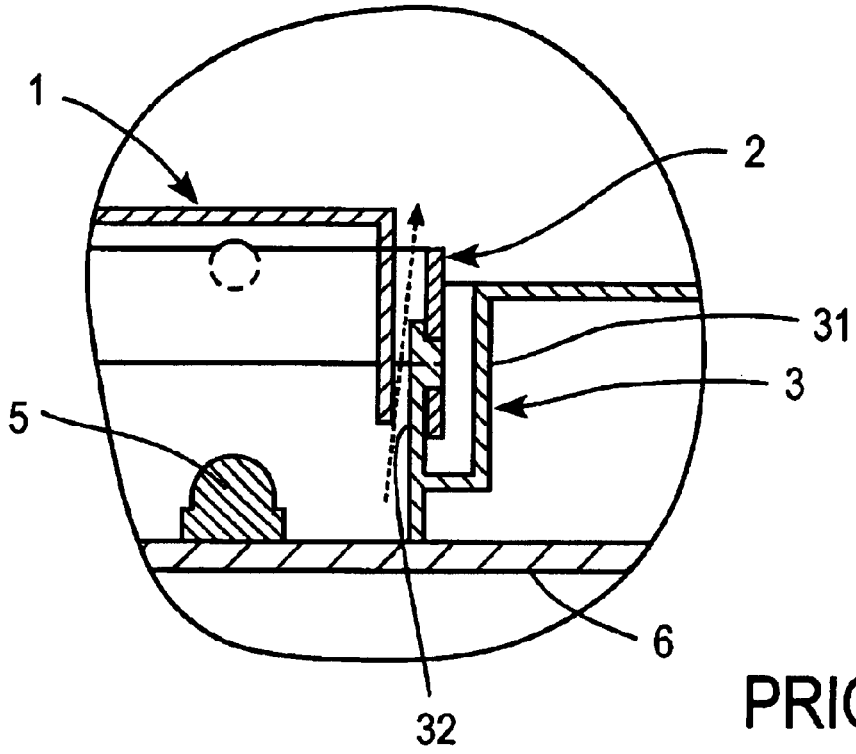
PRIOR ART FIG. 5
FIG. 5 is a sectional view similar to FIG. 4 for explaining the condition that in case of providing a light source in a prior art non-illuminated swing type multi-way switch, light from the light source leaks to the outside.

In this connection, in the swinging mechanism of a prior art non-illuminated swing type multi-way switch, as shown in FIG. 5 for example, a box-like operation knob 1 of a generally square in plan is rotatably disposed in the inside of an inner square tube-like member 32 having a generally square shape in plan of a case 3, and a frame-shaped holder 2 of a generally square in plan is rotatably disposed in the outside of the inner square tube-like member 32 of the case 3. Accordingly, as shown in FIG. 5, if a light source 5 is disposed on the central portion of a base plate 6 of a generally square in plan and the periphery of the light source 5 is surrounded by the inner square tube-like member 32 of the case 3, it is possible to illuminate sufficiently all over the rear surface of the top wall of the operation knob 1 by light irradiated from the light source 5. In addition, it does not occur that light irradiated from the light source 5 leaks directly to the outside of the multi-way switch. However, as shown in FIG. 5, there exists a gap between the outer surface of the side wall of the operation knob 1 and the inner surface of the side wall of the inner square tube-like member 32 of the case 3. For this reason, there is a defect that a portion of the irradiated light is irregularly reflected by the base plate 6, the inner square tube-like member 32 and the holder 2 and leaks to the outside of the multi-way switch from the gap between the outer surface of the side wall of the operation knob 1 and the inner surface of the side wall of the inner square tube-like member 32 as shown by a dotted line arrow.

Figure 6:
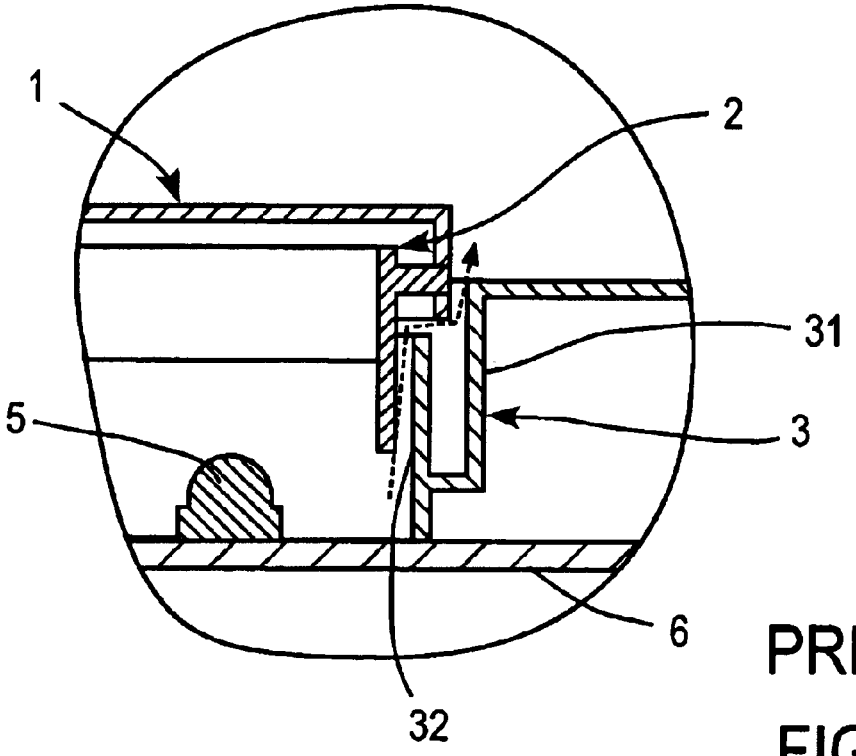
PRIOR ART FIG. 6
FIG. 6 is a sectional view similar to FIG. 4 for explaining the condition that in case of providing a light source in another prior art non-illuminated swing type multi-way switch, light from the light source leaks to the outside.

Also, in the swinging mechanism of another prior art non-illuminated swing type multi-way switch, as shown in FIG. 6 for example, a frame-shaped holder 2 of a generally square in plan is rotatably disposed in the inside of an inner square tube-like member 32 having a generally square shape in plan of a case 3, and a box-like operation knob 1 of a generally square in plan has its side wall disposed between the inner square tube-like member 32 and an outer square tube-like member 31 of the case 3. Accordingly, as shown in FIG. 6, if a light source 5 is disposed on the central portion of a base plate 6 of a generally square in plan and the periphery of the light source 5 is surrounded by the inner square tube-like member 32 of the case 3, it does not occur that light irradiated from the light source 5 leaks directly to the outside of the multi-way switch. However, there exists a gap between the outer surface of the side wall of the holder 2 and the inner surface of the side wall of the inner square tube-like member 32 of the case 3. For this reason, there is a defect that a portion of the irradiated light is irregularly reflected by the base plate 6, the inner square tube-like member 32 and the holder 2 and leaks to the outside of the multi-way switch from the gap between the outer surface of the side wall of the holder 2 and the inner surface of the side wall of the inner square tube-like member 32 as shown by a dotted line arrow. In addition, light irradiated from the light source 5 is obstructed by the upper portion of the side wall of the holder 2, and hence there is a defect that it is impossible to illuminate sufficiently all over the rear surface of the top wall of the operation knob 1 by light irradiated from the light source 5.

In the above embodiment, the four-directional multi-way switch has been illustrated as a swing type multi-way switch, but a multi-way switch to which the present invention can be applied is not limited to the four-directional multi-way switch. For example, if two projections or tongues hanging down respectively from the lower ends of two corners of the operation knob 1 that are opposed to each other in the direction of one diagonal line thereof are added to the operation knob 1 and two switch elements are added and disposed on positions of the base plate 6 that are opposed to the added switch elements respectively, a six-directional multi-way switch can be constructed. Likewise, if four projections or tongues hanging down respectively from the lower ends of the four corners of the operation knob 1 are added to the operation knob 1 and four switch elements are added and disposed on positions of the base plate 6 that are opposed to the added four switch elements respectively, a eight-directional multi-way switch can be constructed. If the number of projections and the number of switch elements are further increased, a multi-way switch more than eight directions can be constructed.

Alternatively, in the four-directional multi-way switch of the above embodiment, it is also possible to arrange the circuit construction such that when adjacent two switch elements (for example, the switch elements 41 and 42) are turned on or off together by depressing one corner of the top wall 12 of the operation knob 1 to swing it downwardly, another function is selected, which is different from the functions selected when each of the adjacent two switch elements alone is turned on or off. For example, it can be arranged that an AND circuit for adjacent two switch elements is provided, and when a signal is outputted from the AND circuit, another function is selected. In such case, there is obtained an advantage that the four-directional multi-way switch of the above embodiment can be extended up to the eight-directional multi-way switch without adding any projections and corresponding switch elements. Moreover, in the eight-directional multi-way switch provided with eight switch elements, for example, if it is arranged such that an AND circuit for adjacent two switch elements is provided as described above and when a signal is outputted from the AND circuit, another function is selected, the eight-directional multi-way switch can be extended up to the sixteen-directional multi-way switch without need to add any projections and corresponding switch elements.

In addition, though it is constructed that the switch elements are depressed and actuated by the corresponding projections 11A, 11B and 23A, 23B formed integrally with the operation knob 1 and the holder 2, there may be provided independent members or parts that act to depress and actuate the corresponding switch elements with the rotating movement of the operation knob 1 or the holder 2. Further, shapes, structures and sizes of the operation knob, the holder, the case, etc. are mere illustrations, and it goes without saying that various modifications, alterations, and/or changes of the illustrations can be made if the need arises.

As is clear from the foregoing, in accordance with the present invention, a light source built in the multi-way switch is surrounded by the inside wall surface of the inner square tube-like member of the case and the inside wall surface of the frame-like holder that is fitted on the outside wall surface of the inner square tube-like member. In addition, the upper portion and the side walls of the frame-like holder are covered by the box-shaped operation knob, and the lower portions of the side walls of the operation knob as well as the lower portions of the side walls of the holder are accommodated in the ling-like groove of a generally square in plan, that is formed between the outer square tube-like member and the inner square tube-like member of the case. As a result, the light source lies in the condition that any light from the outside is perfectly shut out. Moreover, both the holder and the case are made of a light opaque material, and hence light emitted from the light source does not leak from the periphery of the operation knob. Accordingly, there is entirely no occurrence a problem that the external appearance of the whole of the multi-way switch becomes bad due to the leakage of light from the periphery of the operation knob.

Furthermore, since the top of the inner square tube-like member and the top of the holder are open, any member or element obstructing light does not exist at all between the light source and the rear surface of the top wall of the operation knob. Accordingly, light emitted from the light source reaches the rear surface of the top wall of the operation knob substantially without being obstructed so that it can sufficiently and substantially uniformly illuminate almost all over the rear surface of the operation knob. As a result, for example, in case there are indications such as a sign, symbol, mark, letter, or the like on the top surface of the top wall of the operation knob, that indicate respective functions, these indications stand out by illumination from the light source, which results in that the function selecting operation of the multi-way switch becomes very easy. In addition, since it is possible to carry out the function selecting operation of the multi-way switch with ease even in a dim or dark place, room, area or the like, there is obtained an advantage that an incorrect or erroneous selecting operation comes to substantially zero.

While the present invention has been described with regard to the preferred embodiment shown by way of example, it will be apparent to those skilled in the art that various modifications, alterations, changes, and/or minor improvements of the embodiment described above can be made without departing from the spirit and the scope of the present invention. Accordingly, it should be understood that the present invention is not limited to the illustrated embodiment, and is intended to encompass all such modifications, alterations, changes, and/or minor improvements falling within the scope of the invention defined by the appended claims.

What is claimed is:

1. A swing type multi-way switch comprising:

a box-like operation knob the top of which is closed and the bottom of which is open;

a square frame-shaped holder that is disposed in the inside of said operation knob and rotatably supports the operation knob;

a case that has an outer square tube-like member and an inner square tube-like member coaxially formed, and rotatably supports said holder by a second axis for rotating movement orthogonal to the axis for rotating movement of the operation knob, the side wall of the operation knob and the side wall of the holder being disposed in a groove that is formed between the outer square tube-like member and the inner square tube-like member;

a base plate on which a light source and a plurality of switch elements are to be mounted, and that supports said case, said light source and said plurality of switch elements being disposed and mounted on said base plate such that when the base plate supports the case, the light source is located on substantially the central portion of the inner square tube-like member of the case as well as the plurality of switch elements are located on the outside of the inner square tube-like member of the case.

2. The swing type multi-way switch as set forth in claim 1, wherein the operation knob is formed into a box-like shape of a generally square in plan, a pair of side walls opposed to each other has projections or tongues that are formed integrally therewith and hang down respectively from the lower ends of substantially the same positions of the central portions thereof, and another pair of side walls opposed to each other has fitting holes formed at substantially the same positions of the central portions thereof, these fitting holes being aligned with a straight line passing through the center of the operation knob and each fitting hole passing through the corresponding side wall;

the holder has a shape of a generally square in plan, a pair of frame components opposed to each other has fitting holes formed at substantially the same positions of the central portions thereof, these fitting holes being aligned with a straight line passing through the center of the holder and each fitting hole passing through the corresponding frame component, and another pair of frame components opposed to each other has support axes for the operation knob formed integrally therewith at substantially the same positions of the central portions thereof, each operation knob support axis fitting in the corresponding one of the fitting holes of the operation knob and projecting outwardly, the aforesaid another pair of frame components further having projections or tongues that are formed integrally therewith and hang down respectively from the lower ends of substantially the same positions of the central portions thereof;

the outer square tube-like member and the inner square tube-like member of said case have shapes of a generally square in plan respectively, the bottom of the outer square tube-like member is coupled to and integrally with the outside wall of the inner square tube-like member by use of a coupling flange at a predetermined height position of the inner square tube-like member from the bottom thereof, and a pair of side walls opposed to each other of the inner square tube-like member has support axes for the holder formed integrally therewith at substantially the same positions of the central portions thereof, each holder support axis fitting in the corresponding one of the fitting holes of the holder and projecting outwardly;

said coupling flange has openings formed therein through which the pair of projections of the operation knob and the projections of the holder pass through with a play or gap therebetween, respectively; and the base plate has a shape of a generally square in plan, the light source is disposed on the central portion of the top surface of the base plate, first and third switch elements are aligned with one centerline passing through the light source and disposed on locations where distances from the light source are substantially the same with each other, second and fourth switch elements are aligned with a second centerline orthogonal to said centerline and disposed on locations where distances from the light source are substantially the same with each other, and these switch elements are selectively turned on/off by the pair of projections of the operation knob and the pair of projections of the holder.

3. The swing type multi-way switch as set forth in claim 1, wherein both the holder and the case are made of a light opaque material.

4. The swing type multi-way switch as set forth in claim 2, wherein both the holder and the case are made of a light opaque material.

* * * * *